US007482531B2

(12) United States Patent
Doering

(10) Patent No.: US 7,482,531 B2
(45) Date of Patent: Jan. 27, 2009

(54) INTEGRATED DIGITAL CONTROL FOR STRINGED MUSICAL INSTRUMENT

(76) Inventor: Christopher Doering, 5716 NW. Moonlight Meadow Ct., Lee's Summit, MO (US) 64064

( * ) Notice: Subject to any disclaimer, the term of this patent is extended or adjusted under 35 U.S.C. 154(b) by 0 days.

(21) Appl. No.: 11/551,015

(22) Filed: Oct. 19, 2006

(65) Prior Publication Data

US 2007/0131101 A1 Jun. 14, 2007

Related U.S. Application Data

(60) Provisional application No. 60/748,572, filed on Dec. 8, 2005.

(51) Int. Cl.
*G10H 1/02* (2006.01)
*G10H 1/18* (2006.01)
*G10H 7/00* (2006.01)

(52) U.S. Cl. ..... 84/737; 84/626; 84/663; 84/742

(58) Field of Classification Search ..... 84/737, 84/626, 663, 742
See application file for complete search history.

(56) References Cited

U.S. PATENT DOCUMENTS

| | | | | | |
|---|---|---|---|---|---|
| 3,443,018 | A | * | 5/1969 | Krebs | 84/741 |
| 3,541,912 | A | * | 11/1970 | Radke | 84/715 |
| 3,555,166 | A | * | 1/1971 | Gasser | 84/600 |
| 3,742,114 | A | * | 6/1973 | Barkan | 84/740 |
| 4,336,734 | A | * | 6/1982 | Polson | 84/646 |
| RE31,019 | E | * | 8/1982 | Evangelista | 84/702 |
| 4,580,479 | A | * | 4/1986 | Bonanno | 84/626 |
| 4,653,376 | A | * | 3/1987 | Allured et al. | 84/646 |
| 4,699,038 | A | * | 10/1987 | Wedge | 84/658 |
| 4,748,887 | A | * | 6/1988 | Marshall | 84/646 |
| 4,794,838 | A | * | 1/1989 | Corrigau, III | 84/600 |
| 4,986,157 | A | * | 1/1991 | Matsubara | 84/46 |
| 5,065,659 | A | * | 11/1991 | Uchiyama et al. | 84/723 |
| 5,085,119 | A | * | 2/1992 | Cole | 84/724 |
| 5,085,120 | A | * | 2/1992 | Ishiguro | 84/737 |
| 5,121,668 | A | * | 6/1992 | Segan et al. | 84/646 |
| 5,121,669 | A | * | 6/1992 | Iba et al. | 84/735 |
| 5,286,911 | A | * | 2/1994 | Murata et al. | 84/615 |
| 5,300,730 | A | * | 4/1994 | Ekhaus | 84/734 |
| 5,478,969 | A | * | 12/1995 | Cardey et al. | 84/626 |
| 5,561,257 | A | * | 10/1996 | Cardey et al. | 84/626 |

(Continued)

OTHER PUBLICATIONS

Rogers and Cowan; Modern Guitars Magazine; May 15, 2006; Gibson Digital Guitar Set to Rock WinHec 2006.

*Primary Examiner*—Walter Benson
*Assistant Examiner*—Christina Russell
(74) *Attorney, Agent, or Firm*—Hovey Williams LLP

(57) ABSTRACT

Embodiments of the present invention provide an integrated digital control apparatus (10) for a stringed musical instrument. In some embodiments, the apparatus (10) generally includes an input (26) coupled with at least a portion of the musical instrument, a digital control element (28) coupled with at least one of the instrument's pickups, and a controller (30) coupled with the input (26) and the digital control element (28). The controller (30) is operable to control the digital control element (28) to vary at least one characteristic of the signal generated by the pickup in response to functioning of the input (26) by a musician. Such a configuration enables the musician to easily vary signal characteristics, such as volume or tone, while playing the instrument.

22 Claims, 4 Drawing Sheets

U.S. PATENT DOCUMENTS

| | | | | | |
|---|---|---|---|---|---|
| 5,633,474 | A * | 5/1997 | Cardey, III | 84/663 |
| 5,698,808 | A * | 12/1997 | Hamlin | 84/722 |
| 5,866,834 | A * | 2/1999 | Burke et al. | 84/622 |
| 5,990,411 | A * | 11/1999 | Kellar | 84/742 |
| 6,018,119 | A * | 1/2000 | Mladek | 84/722 |
| 6,034,316 | A * | 3/2000 | Hoover | 84/738 |
| 6,242,682 | B1 * | 6/2001 | Marinic et al. | 84/626 |
| 6,479,741 | B1 * | 11/2002 | Morton et al. | 84/644 |
| 7,112,738 | B2 * | 9/2006 | Hyakutake et al. | 84/737 |
| 7,161,080 | B1 * | 1/2007 | Barnett | 84/613 |
| 2004/0107822 | A1 * | 6/2004 | Olvera et al. | 84/743 |
| 2004/0163529 | A1 * | 8/2004 | Hyakutake et al. | 84/737 |
| 2004/0244566 | A1 * | 12/2004 | Steiger | 84/610 |
| 2005/0183566 | A1 * | 8/2005 | Nash | 84/601 |
| 2005/0211081 | A1 * | 9/2005 | Bro et al. | 84/737 |
| 2006/0191401 | A1 * | 8/2006 | Ueshima et al. | 84/724 |

* cited by examiner

INTEGRATED DIGITAL CONTROL FOR STRINGED MUSICAL INSTRUMENT

RELATED APPLICATIONS

The present non-provisional application claims the benefit of U.S. Provisional Patent Application No. 60/748,572, filed Dec. 8, 2005. The identified provisional application is incorporated herein by specific reference.

BACKGROUND OF THE INVENTION

1. Field of the Invention

Embodiments of the present invention relate to an integrated digital control for stringed musical instruments. More particularly, various embodiments of the invention provide an integrated digital control apparatus operable to vary characteristics of a signal generated by a stringed instrument.

2. Description of the Related Art

As shown in FIGS. 1(*a*) and 1(*b*), electric guitars, and innumerable other stringed musical instruments, are generally provided with integral tone and volume control knobs 100 operable to alter the volume and tone of generated signals. These control knobs generally include one or more analog potentiometers that vary the resistance of signals propagating from electronic pickups.

Although these analog potentiometer control knobs are operable to vary volume and tone, they must be positioned on the base of guitars due to the size and configuration of their analog components. As a result, musicians must stop playing during performances to move their hands from the strings to the knobs in order to vary the volume or tone of generated signals. Consequently, musicians are often unable to utilize the analog control knobs to dynamically alter volume and tone while performing and must rely on static and potentially undesirable pre-set configurations.

SUMMARY OF THE INVENTION

Embodiments of the present invention solve the above-described problems and provide a distinct advance in the art of controls for stringed musical instruments. More particularly, various embodiments of the invention provide an integrated digital control apparatus operable to vary characteristics of a signal generated by a stringed instrument. Such a configuration enables musicians to quickly and accurately vary the volume, tone, and/or other signal characteristics, while playing.

In one embodiment, the present invention provides a digital control apparatus for a stringed musical instrument. The stringed musical instrument includes a plurality of strings and a pickup operable to generate a signal corresponding to vibrations of the strings. The digital control apparatus includes an input coupled with at least a portion of the musical instrument, a digital control element coupled with the pickup, and a controller coupled with the input and the digital control element. The controller is operable to control the digital control element to vary at least one characteristic of the signal generated by the pickup in response to functioning of the input by a musician.

In another embodiment, the instrument is a guitar and the apparatus includes a plurality of functionable inputs positioned on the neck of the guitar, a digital potentiometer coupled with the guitar's pickup, and a controller coupled with the inputs and the digital potentiometer. The digital potentiometer is operable to change its resistance to vary at least one characteristic of the signal and the controller is operable to control the digital potentiometer to vary at least one signal characteristic in response to functioning of at least one of the inputs by the musician.

In another embodiment, the present invention provides an electric guitar including a body having a base and a neck extending therefrom, a plurality of strings extending from the base, a pickup positioned in proximity to the strings and operable to generate a signal corresponding to vibrations of the strings, a signal output operable to provide the generated signal to an external device, a plurality of inputs positioned on the neck, first and second digital potentiometers, and a controller coupled with the inputs and the potentiometers. The inputs include a tone input and a volume input operable to be functioned by a musician. The first digital potentiometer is operable to change its resistance to vary the volume of the signal and the second digital potentiometer is operable to change its resistance to vary the tone of the signal. The controller is operable to control the first digital potentiometer to vary the volume of the signal in response to functioning of the volume input by the musician and control the second digital potentiometer to vary the tone of the signal in response to functioning of the tone input by the musician.

Other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described below with reference to the attached drawing figures, wherein:

FIG. 1(*b*) is a block diagram of prior art volume and tone controls;

Figure 1A:
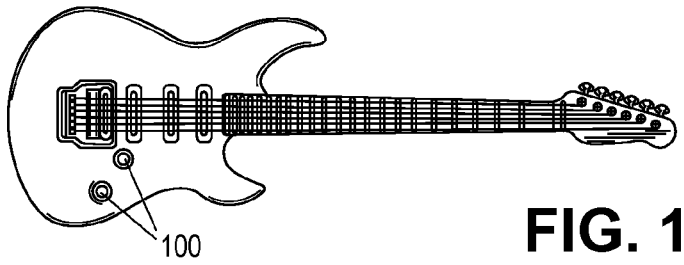
FIG. 1A (PRIOR ART)
FIG. 1(*a*) is a front view of a prior art electric guitar.
Figure 1B:
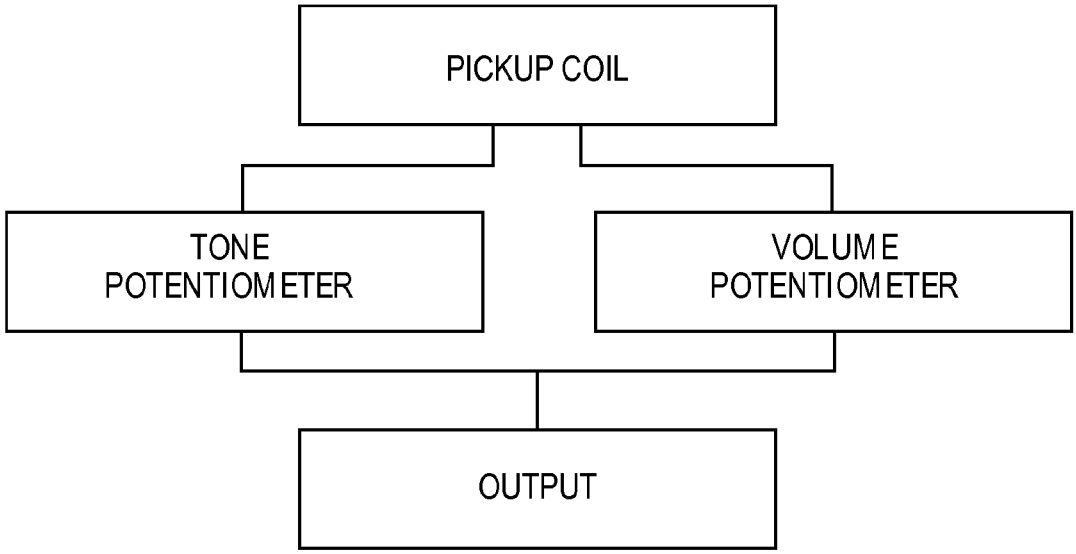
FIG. 1B (PRIOR ART)

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

The following detailed description of the invention references the accompanying drawings which illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

With reference to FIGS. 1-4, embodiments of the present invention generally provide a digital control apparatus 10 operable for varying the volume, tone, or other characteristics of a signal generated by a musical instrument, such as a guitar. The apparatus 10 is preferably integral or coupled with the instrument such that it does not require external coupling with an amplifier or external control board.

Preferably, apparatus 10 is utilized with an electric guitar 12. The guitar 12 generally includes a body 14 having a base 16 and a neck 18 extending therefrom, a head positioned on a distal end of the neck 18, a plurality of strings 20 extending between the base 16 and the head, at least one pickup 22 positioned in proximity to the strings 20 and operable to generate a signal corresponding to vibrations of the strings 20, and a signal output 24 operable to provide the generated signal to an external device such as an amplifier.

Thus, the guitar 12 may include generally conventional guitar components that are operable to convert the vibration of metallic strings into an electrical signal which may be fed into an internal or external amplifier to generate sound. For instance, the pickup 22 may be a single or multiple-coil magnetic pickup, a humbucking pickup, a piezoelectric pickup, a multi-transducer pickup, an electromagnetic pickup, an optical pickup, an active or passive pickup, combinations thereof, etc. Additionally, in some embodiments the guitar 12 may include a plurality of pickups 22 configured in a substantially conventional manner.

As should be appreciated by those skilled in the art, the apparatus 10 may couple with any type of stringed-musical instrument that generates an electrical signal in response to string movement or vibration, such that use of the apparatus 10 is not limited to the guitar 12 discussed herein. For example, the apparatus 10 may be used with electric bass guitars, electric violins, etc.

The apparatus 10 generally includes an input 26 coupled with at least a portion of the guitar 12 and operable to be functioned by a musician, a digital control element 28 coupled with the pickup 22 and operable to vary at least one characteristic of the signal generated by the pickup 22, and a controller 30 coupled with the input 26 and digital control element 28 operable to control the digital control element 28 based on functioning of the input 26. Preferably, the apparatus 10 includes a plurality of inputs 26 and a plurality of digital control elements 28.

The input 26 may comprise any type of input operable to be functioned or activated by the musician. Preferably, the apparatus 10 comprises a plurality of inputs 26 each operable to be functioned by the musician to control the operation of one or more of the digital control elements 28. In various embodiments, the inputs 26 comprise a plurality of push-button microswitches 32. Each microswitch may be depressed or otherwise functioned to provide an input to the controller 30.

For instance, as is discussed in more detail below, a first input may be depressed to increase volume, a second input may be depressed to increase tone, a third and the first input may be depressed to decrease volume, and the third and the second input may be depressed to decrease tone. Similarly, separate inputs may be provided to increase and decrease tone and volume. Thus, the inputs 26 may include one or more volume and tone inputs. As should be appreciated, any combination or configuration of inputs may be provided to control operation of the controller 30 or apparatus 10. For instance, in some embodiments where only volume is controlled, the inputs 26 may comprise one button for increasing volume and one button for decreasing volume.

Further, the inputs 26 may also be functioned to control other features of the instrument or external devices, such as effect pedals and amplifiers, by including power or effect inputs. Also, the inputs 26 need not be limited to the microswitches 32, as the inputs 26 may include any combination of functionable elements, including toggle switches, dials, pressure-sensitive switches, touch pads, slidable switches, thermal and optical sensors, etc.

Figure 3:
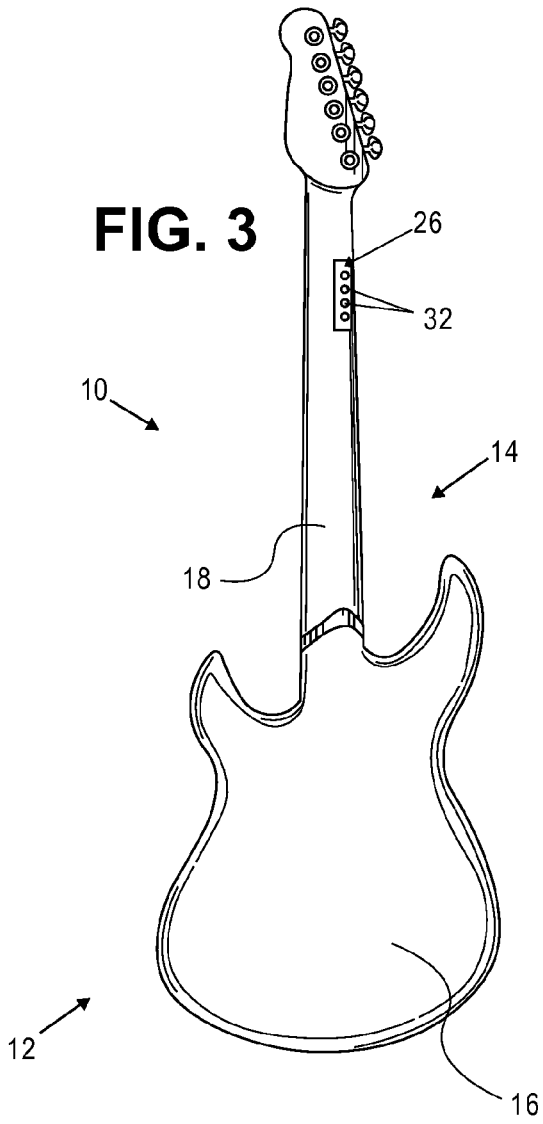
FIG. 3 is a rear view of the guitar of FIG. 2.
Figure 4:
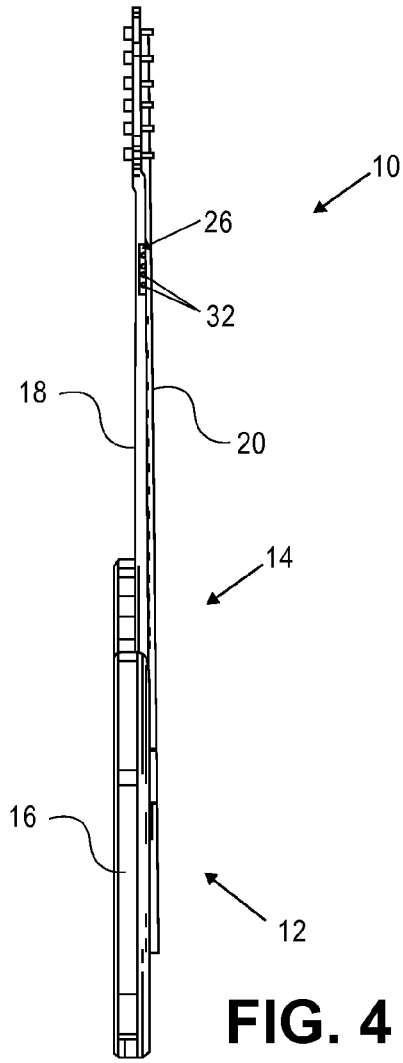
FIG. 4 is a top view of the guitar of FIGS. 2-3.

In embodiments where the instrument is the guitar 12, the inputs 26 are preferably positioned on the neck 18 of the guitar 12 to enable the musician to function the inputs 26 with one hand while still playing the guitar by stroking or strumming the strings 20 with the other hand. As should be appreciated, such a configuration enables the musician to independently and dynamically function the inputs 26 to vary signal characteristics while performing. Similarly, positioning of the inputs 26 on the neck 18 of the guitar 12 enables the musician to dynamically control external devices, such as foot pedals and amplifiers, while performing. In some embodiments, the inputs 26 may be positioned on the neck 18 towards the head of the guitar 12, as shown in FIGS. 3 and 4, or be positioned on the neck 18 towards the base 16 of the guitar 12. However, the inputs 26 may be positioned elsewhere on the guitar 12, including its base 16 and head.

In some embodiments, the inputs 26 may be arranged on a circuit board, or other connecting medium, embedded into or on the surface of the neck 18. The connecting medium may be repositionable on the neck 18 to enable the musician to select the position of the inputs 26. In other embodiments, the inputs 26 may themselves be embedded into or on the neck 18, or other portion of the guitar 12. Preferably, the inputs 26 are positioned on the neck 18 such that only the functionable portions of the inputs 26 are viewable or otherwise exposed, thereby limiting interference with normal operation of the guitar 12.

The digital control elements 28 are coupled with the controller 30 and are operable to vary characteristics of the signal generated by the instrument. The digital control elements 28 are electrically coupled with the instrument to vary tone, volume, or other signal characteristics generated by portions of the instrument. In embodiments where the musical instrument is the guitar 12, the digital control elements 28 are coupled with one or more of the pickups 22, as shown in FIG. 5.

The digital control elements 28 may include any digital devices or elements operable to vary electrical signal characteristics. Thus, the digital control elements 28 may include digital devices that vary the volume, tone, pitch, phase, frequency, and noise levels (distortion) of electrical signals. In various embodiments, the digital control elements 28 include at least one digital potentiometer operable to vary its resistance, such as the MAX5160/MAX5161 distributed by MAXIM INTEGRATED PRODUCTS.

Figure 5:
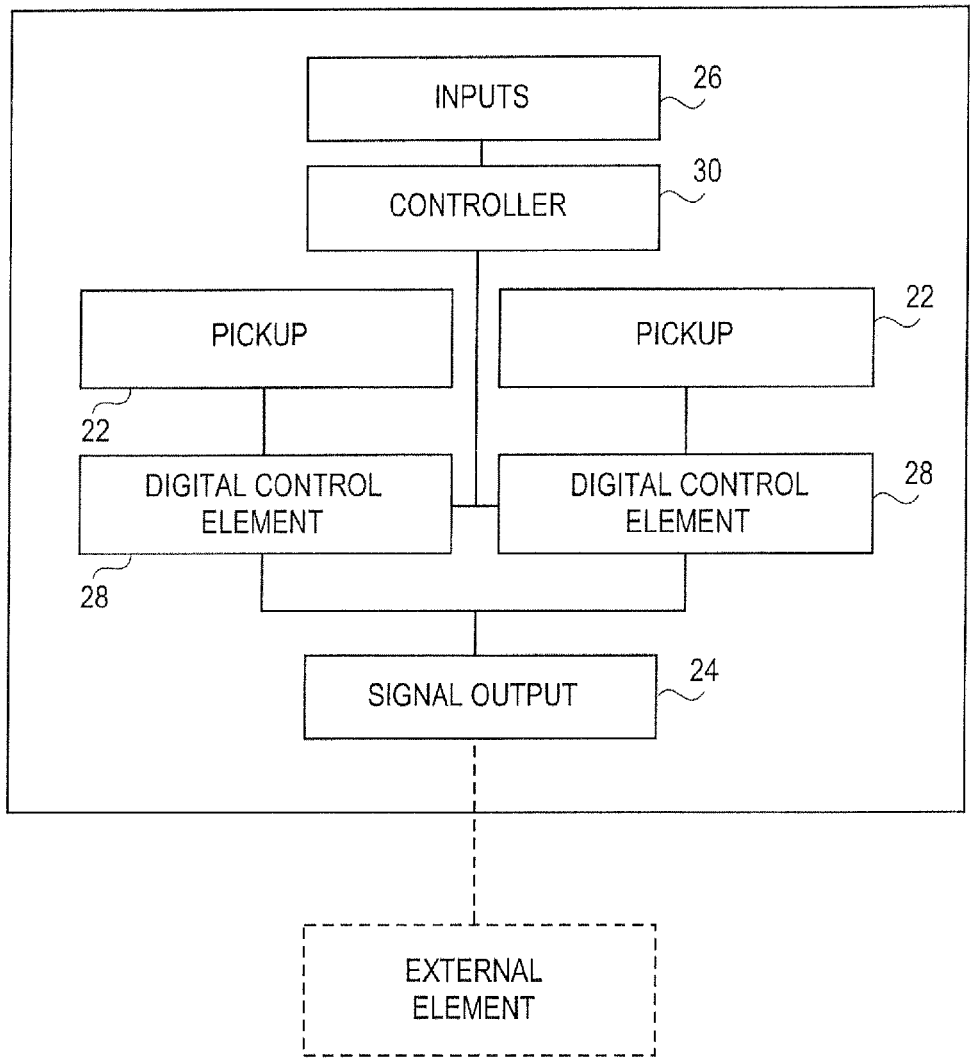
FIG. 5 is a block diagram illustrating various elements of the integrated digital control apparatus of FIGS. 2-4.

As shown in FIG. 5, the digital control elements 28 are preferably coupled between the pickups 22 and signal output 24 of the guitar. Such a configuration enables the digital control elements 28 to vary the signal provided by each pickup 22 to change the volume, tone, or other characteristic of the signal before the signal is output through the signal output 24 and amplified by an amplifier. However, as should be appreciated, the digital control elements 28 may be utilized with devices not having pickups or electromagnetic coils as the digital components are operable to vary electrical signal characteristics regardless of the signal source.

In some embodiments, a plurality of digital potentiometers may be integrated into one digital control element 28. In such embodiments, a single digital control element 28 may be coupled with more than one pickup 22 to vary more than one signal characteristic. Further, as should be appreciated by those skilled in the art, a plurality of digital control elements 28 may be coupled with only one pickup 22 to vary one or more signal characteristics.

The controller 30 is operable to control the functionality of the digital control elements 28 in response to functioning of the inputs 26. The controller 30 may include a processor, a microcontroller, a combination of discrete digital or analog elements, an application specific integrated circuit, a programmable logic device, combinations thereof, etc. In preferred embodiments, the controller 30 includes a microcontroller, such as the ATTINY13 microcontroller distributed by ATMEL CORP.

The controller 30 is coupled with both the digital control elements 28 and the inputs 26. The controller 30 may include logic and/or a computer program operable to control the digital control elements 28 in a specific manner to achieve a desired result. For instance, should the musician function the volume input, the controller 30 is operable to control the digital control elements 28 to vary the volume as indicated by the musician.

For instance, in embodiments where the digital control elements 28 comprise one or more digital potentiometers, the controller 30 is operable to control the digital potentiometers to vary their resistance or impedance based upon the position or function of the inputs 26. By varying the resistance provided by the digital potentiometers, the volume and tone of the generated electrical signal may be varied. For instance, increasing resistance decreases volume and changes tone in a first direction while decreasing resistance increases volume and changes tone in a second direction. Such relationships between resistance, volume, and tone are well known in the art.

Preferably, a first digital potentiometer is coupled with a first one of the pickups 22 to vary volume and a second digital potentiometer is coupled with a second of the pickups 22 to vary tone. Utilization of at least two potentiometers to vary volume and tone is desirable as it enables volume and tone to be varied independent of each other. However, as discussed above, the digital control elements 28 and pickups 22 may be coupled in any configuration to provide any desired result.

Additionally, in some embodiments the controller 30 is operable to vary other signal characteristics, control other instrument elements, and/or control and function external devices. For instance, in response to functioning of one or more of the inputs 26, the controller 30 may be operable to power the instrument on and off and/or change the pitch, phase, frequency, distortion and noise level, etc, of the signal. The controller 30 may include or be coupled with other signal processing elements, in addition to or instead of the digital control elements 30, to modify the signal generated by the pickups 22 in any manner.

In some embodiments, the apparatus 10 is operable to couple with elements and devices external to the instrument, such as amplifiers, control systems, computing elements, displays, external effects elements such as foot pedals, etc. In such embodiments, the controller 30 is operable to control or function external elements based upon functioning of the inputs 26. For example, in response to functioning of one or more of the inputs 26, the controller 30 may increase or decrease the volume of an external amplifier, turn the external amplifier on or off, control external sound systems, interface the instrument with computing elements, provide data and information to interfaced computing elements, control the functionality of external displays or monitors, control external effects elements such as foot pedals, combinations thereof, etc.

The apparatus 10 may also include various analog components to facilitate its operation. For instance, the apparatus 10 may include a battery to power the controller 30 and digital control elements 28. Also, the apparatus 10 may include various resistors, capacitors, and filters operable to filter the signal or otherwise facilitate operation of the inputs 26, digital control elements 28, and controller 30.

In some embodiments, the apparatus 10 may include analog and/or digital filter elements coupled with the inputs 26 to eliminate undesirable noise caused by functioning of the inputs 26. For example, the apparatus 10 may include band-pass filters and/or de-bouncing circuitry to prevent popping and other switch-related noises from being included within signals generated by the guitar 12.

In various embodiments, the battery may be integral with the guitar 12, such as by being a removable AA battery, or the power source may be external to the guitar 12 such as where the digital control elements 28 and/or controller 30 are powered by the pickups or other instrument components.

As should be appreciated by those skilled in art, any combination or configuration of digital components may be utilized by the present invention such that the present invention is not limited to the inputs 26, digital control elements 28, and controller 30 discussed above. Thus, any digital component operable to vary the resistance and/or impedance of an electrical signal may be utilized by the present invention. Additionally, any digital component operable to process or modify an electric signal may be utilized by the present invention. Further, any digital component operable to control or function other digital and non-digital components may be utilized by the present invention.

In some embodiments, the controller 30 and the digital control elements 28 are integral. For instance, the controller 30 and digital control elements 28 may be integrated into a single integrated circuit or circuit package for convenient integration into the guitar 12. Further, in some embodiments the inputs 26, digital control elements 28, and controller 30 may be integrated and each mounted or otherwise coupled to the neck 18 of the guitar 12.

Figure 2:
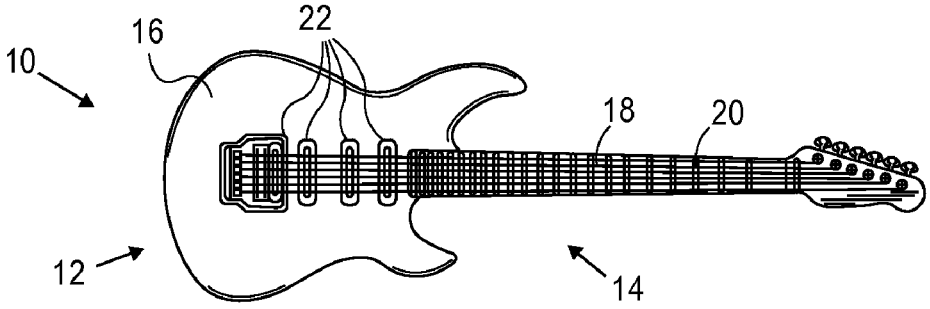
FIG. 2 is a front view of a guitar including an integrated digital control apparatus configured in accordance with various preferred embodiments of the present invention.

Further, in embodiments where the inputs 26 are positioned on the neck 18 of the guitar, the base 16 of the guitar 12 may present a flat front face lacking protrusions or knobs as shown in FIG. 2. As a result, the guitar 12 including the apparatus 10 may present a flatter profile than conventional electrical guitars and facilitate a more aggressive style of play as musicians need not worry about striking their hands on projecting knobs or accidentally altering tone and volume levels during play.

In operation, the musician couples the guitar 12 to an external element, such an amplifier, using the signal output 24. For instance, the musician may connect the signal output 24 and amplifier using a cable. However, in some embodiments the guitar 12 may include an integral amplifier such that coupling with an external amplifier is not necessary.

In some embodiments, the musician may activate the guitar 12 by functioning one of the inputs 26. The musician may then use the guitar in a conventional manner. Should the musician desire to change a characteristic of the signal generated by the guitar 12, and thus the sound emanating from the amplifier, the musician may function one or more of the inputs 26. For instance, as discussed above, the musician may function one or more of the inputs 26 to change the volume, tone, or other characteristic of the signal. In response to functioning of the inputs 26, the controller 30 controls the digital control elements 28 in a desired manner, such as by controlling their resistance or impedance.

In embodiments where the inputs 26 are mounted on the neck 18 of the guitar 12, the musician may easily function the inputs 26, to change volume, tone, or any other signal characteristic, with the thumb of his left hand while continuing to finger the strings 20 with the fingers of his left hand and strumming the strings 20 with his right hand. Thus, the musician may modify signal characteristics using the inputs 26 while simultaneously playing the guitar 12 in a conventional manner. Further, as also discussed above, the musician may function the inputs 26 while playing to control elements external the guitar 12, such as the amplifier.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A digital control apparatus for a stringed musical instrument, the stringed musical instrument including a plurality of strings, a pickup operable to generate a signal corresponding to vibrations of the strings, and a signal output, the digital control apparatus consisting of:

an input embedded within the musical instrument and operable to be functioned by a musician;

a digital control element coupled with the pickup and coupled with the signal output and operable to vary at least one characteristic of the signal generated by the pickup before the signal is communicated to the signal output; and a controller coupled with the input and the digital control element, the controller operable to control the digital control element to vary at least one characteristic of the signal generated by the pickup in response to functioning of the input by the musician, wherein said digital control apparatus is housed within the stringed musical instrument.

2. The apparatus of claim 1, wherein the controller and digital control element are integral.

3. The apparatus of claim 1, wherein the characteristic varied by the digital control element is selected from the group consisting of: volume, tone, pitch, phase, frequency, and distortion.

4. The apparatus of claim 1, wherein the digital control element includes a digital potentiometer operable to change its resistance to vary at least one characteristic of the signal.

5. The apparatus of claim 1, further including a second digital control element operable to vary a second signal characteristic.

6. The apparatus of claim 1, wherein the stringed musical instrument includes a neck, and the input is positioned on the neck.

7. The apparatus of claim 1, wherein the input includes a push-button microswitch.

8. A digital control apparatus for an electric guitar and at least one external device that is external to the guitar, the guitar including aneck, a plurality of strings, a signal output, and a pickup operable to generate a signal corresponding to vibrations of the strings, the digital control apparatus consisting of:

a plurality of inputs embedded in the neck of the guitar, each of the inputs operable to be functioned by a musician;

a digital potentiometer coupled with the pickup and coupled with the signal output and operable to change its resistance to vary at least one characteristic of the signal before the signal is communicated to the signal output; and a controller coupled with the input and the digital potentiometer, the controller operable to control the digital potentiometer to vary at least one signal characteristic in response to functioning of at least one of the inputs by the musician, wherein the controller is operable to control the at least one external device.

9. The apparatus of claim 8, wherein the controller and digital potentiometer are integral.

10. The apparatus of claim 8, wherein the characteristic varied by the digital potentiometer is selected from the group consisting of: volume, tone, pitch, phase, frequency, distortion, and noise level.

11. The apparatus of claim 8, further including a second digital potentiometer operable to vary a second signal characteristic.

12. The apparatus of claim 8, wherein the inputs are selected from the group consisting of: push-button microswitches, toggle switches, dials, touch pads, slidable switches, thermal sensors, and optical sensors.

13. The apparatus of claim 8, wherein a first one of the inputs is operable to be functioned by the musician to change the volume of the signal and a second one of the inputs is operable to be functioned by the musician to change the tone of the signal.

14. The apparatus of claim 8, wherein the at least one external device is an amplifier.

15. The apparatus of claim 14, wherein the controller is operable to control the volume of the amplifier.

16. The apparatus of claim 8, wherein the at least one external device is selected from the group consisting of: an amplifier, a control system, a computing element, a display, and an effects element.

17. The apparatus of claim 16, wherein the controller is operable to control the at least one external device by performing a control selected from the group consisting of: increasing or decreasing a volume of the amplifier, powering the amplifier on or off, controlling external sound systems, interfacing the guitar with the computing elements, providing data and information to the interfaced computing element, controlling a functionality of the display, and controlling the effects element.

18. An electric guitar consisting of:

a body including a base and a neck extending therefrom;

a plurality of strings extending from the base;

a first pickup and a second pickup positioned in proximity to the strings and operable to generate a signal corresponding to vibrations of the strings;

a signal output operable to provide the generated signal to an external device;

a plurality of inputs embedded in the neck including a tone input and a volume input, each of the inputs operable to be functioned by a musician;

a first digital potentiometer coupled with the first pickup and the signal output;

a second digital potentiometer coupled with the second pickup and the signal output;

a controller coupled with the inputs and the digital potentiometers, the controller operable to— control the first digital potentiometer to vary a volume of the signal in response to functioning of the volume input by the musician, and control the second digital potentiometer to vary a tone of the signal in response to functioning of the tone input by the musician;

a battery coupled with the guitar and operable to power the controller; and a filter coupled with at least one of the plurality of inputs and operable to eliminate noise caused by functioning of the input.

19. The guitar of claim 18, wherein the signal output is operable to be coupled with an amplifier and the plurality of inputs include a power input operable to be functioned by the musician to instruct the controller to power the amplifier on and off.

20. The guitar of claim 18, wherein the inputs comprise a plurality of push-button microswitches.

21. The guitar of claim 18, wherein the controller and digital potentiometers are integral.

22. The guitar of claim 18, wherein the controller and digital potentiometers are positioned within the base of the guitar.

* * * * *